US010716446B2

(12) United States Patent
Isenberg et al.

(10) Patent No.: US 10,716,446 B2
(45) Date of Patent: Jul. 21, 2020

(54) WET CLEANING APPARATUS FOR CLEANING AN AREA

(71) Applicant: Vorwerk & Co. Interholding GmbH, Wuppertal (DE)

(72) Inventors: Gerhard Isenberg, Cologne (DE); Roman Ortmann, Duisburg (DE)

(73) Assignee: VORWERK & CO. INTERHOLDING GMBH, Wuppertal (DE)

( * ) Notice: Subject to any disclaimer, the term of this patent is extended or adjusted under 35 U.S.C. 154(b) by 32 days.

(21) Appl. No.: 16/185,227

(22) Filed: Nov. 9, 2018

(65) Prior Publication Data

US 2019/0142237 A1 May 16, 2019

(30) Foreign Application Priority Data

Nov. 10, 2017 (DE) ..... 10 2017 126 414

(51) Int. Cl.
*A47L 11/40* (2006.01)

(52) U.S. Cl.
CPC ..... *A47L 11/4055* (2013.01); *A47L 11/4005* (2013.01); *A47L 11/4011* (2013.01); *A47L 11/4066* (2013.01); *A47L 11/4091* (2013.01); *A47L 2201/022* (2013.01); *A47L 2201/04* (2013.01); *A47L 2201/06* (2013.01)

(58) Field of Classification Search
CPC ..... A47L 11/4055; A47L 11/4005; A47L 11/4011; A47L 11/4066; A47L 11/4091; A47L 2201/022; A47L 2201/04; A47L 2201/06
See application file for complete search history.

(56) References Cited

U.S. PATENT DOCUMENTS

| | | | | |
|---|---|---|---|---|
| 8,892,251 | B1 * | 11/2014 | Dooley | A47L 11/4011 700/245 |
| 9,265,396 | B1 * | 2/2016 | Lu | A47L 13/24 |
| 10,383,499 | B2 * | 8/2019 | Fox | B25J 9/0003 |
| 2002/0011813 | A1 * | 1/2002 | Koselka | A47L 11/24 318/445 |

* cited by examiner

*Primary Examiner* — Dung Van Nguyen
(74) *Attorney, Agent, or Firm* — Collard & Roe P.C.

(57) ABSTRACT

A wet cleaning apparatus has a cleaning element for mechanically wet cleaning an area to be cleaned and a device section that supports the wet cleaning apparatus relative to the area. The wet cleaning apparatus comprises a displacement device that is designed for automatically causing a displacement of the cleaning element relative to the device section or vise versa in dependence on a state of motion and/or an error status of the wet cleaning apparatus such that the cleaning element can be displaced from an operating position, in which it is lowered onto the area, into a distant position, in which it is lifted off the area. A detection device is assigned to the displacement device and is designed for distinguishing between a standstill of the wet cleaning apparatus and a motion of the wet cleaning apparatus.

8 Claims, 6 Drawing Sheets

WET CLEANING APPARATUS FOR CLEANING AN AREA

CROSS REFERENCE TO RELATED APPLICATIONS

Applicant claims priority under 35 U.S.C. § 119 of German Application No. 10 2017 126 414.0 filed on Nov. 10, 2017, the disclosure of which is incorporated by reference.

BACKGROUND OF THE INVENTION

1. Field of the Invention

The invention relates to a wet cleaning apparatus with a cleaning element for mechanically wet cleaning an area to be cleaned and with a device section that supports the wet cleaning apparatus relative to the area. The wet cleaning apparatus comprises a displacement device that is designed for automatically causing a displacement of the cleaning element relative to the device section or vise versa in dependence on a state of motion and/or an error status of the wet cleaning apparatus such that the cleaning element can be displaced from an operating position, in which it is lowered onto the area, into a distant position, in which it is lifted off the area.

The invention furthermore relates to a set consisting of a wet cleaning apparatus of the aforementioned type and a base station for charging an accumulator of the wet cleaning apparatus, wherein the wet cleaning apparatus is a self-traveling cleaning robot, and wherein the wet cleaning apparatus and the base station comprise corresponding electrical contacts.

2. Description of the Related Art

Wet cleaning apparatuses of the aforementioned type are known from the prior art in a variety of different designs. The wet cleaning apparatuses may be realized, for example, in the form of wet cleaning devices, the cleaning element of which consists of a cleaning cloth that acts upon an area.

The cleaning element may be arranged, for example, on a roller that rotates about an essentially horizontal or vertical axis of rotation or on a carrier plate that is essentially oriented parallel to the area to be cleaned.

The wet cleaning apparatus may be realized in the form of a wet cleaning apparatus that is hand-operated by a user or in the form of a self-traveling wet cleaning apparatus similar to an autonomous cleaning robot. The cleaning task performed by the wet cleaning apparatus is a wet-wiping process, in which a cleaning agent preferably is applied onto the cleaning element or the area to be cleaned. Furthermore, the term wet cleaning apparatus may also refer to polishing apparatuses or similar devices, which carry out a mechanical treatment of an area by supplying a liquid.

The above-described wet cleaning apparatuses have the disadvantage that the cleaning element usually always remains in contact with the area to be cleaned. When the cleaning process is interrupted or completed, an excessively long exposure of the area to be cleaned to the cleaning agent may lead to damages to the area. It is particularly possible that a wet cleaning element lies on the area to be cleaned for a prolonged period of time and thereby causes the area to swell. This swelling risk particularly applies if the area consists of a wood floor.

SUMMARY OF THE INVENTION

Based on the aforementioned prior art, it is an object of the invention to develop a wet cleaning apparatus, in which an inadvertent exposure of the area to the cleaning element for an excessively long period of time is prevented.

In order to attain this objective, it is proposed that a detection device is assigned to the displacement device and is designed for distinguishing between a standstill of the wet cleaning apparatus and a motion of the wet cleaning apparatus, wherein the displacement device is designed for causing a displacement of the cleaning element into the distant position when a standstill is detected. Alternatively, the detection device is designed for determining the value of a current moving speed of the wet cleaning apparatus relative to the area and for comparing the determined value with a threshold value stored in a memory, wherein the displacement device is designed for causing a displacement of the cleaning element into the distant position if the threshold value is not reached.

The cleaning element can be displaced with respect to its height, namely at least proportionately in a direction that is not oriented parallel to the surface of the area, depending on the state of motion and/or an error status of the wet cleaning apparatus. The cleaning element is automatically and, in particular, completely lifted off the area, for example, if the wet cleaning apparatus remains motionless on the area to be cleaned for a prolonged period of time and/or has an error status, particularly if a mobile robot gets stuck or stops because the accumulator is completely discharged. Damage to the area, for example, by a wet cleaning element and/or a cleaning element coated with a cleaning agent are thereby prevented. For example, swelling of a floor of the area due to a wet cleaning element can no longer occur. The wet cleaning apparatus may comprise, for example, a control unit that is assigned to the displacement device and generates a control command, which actuates a mechanism for lifting the cleaning element off the area. In this case, the displacement of the cleaning element may be realized, for example, by pivoting or displacing the cleaning element relative to the device section or by pivoting or displacing the device section relative to the cleaning element.

With respect to the desired effect, it is irrelevant which element, i.e. the cleaning element or the device section, is respectively displaced relative to the other element by the displacement device. Since the device section being supported on the area defines a contact region with the area, a displacement of the cleaning element relative to the device section—at unchanged contact of the device section with the area—at the same time also implies a displacement of the cleaning element relative to the area. The displacement of the cleaning element and/or the device section is preferably realized in a motor-driven manner by means of an electric motor or with the released restoring force of a spring element assigned to the displacement device or even pneumatically, for example by utilizing an air flow of a fan of the wet cleaning apparatus.

The wet cleaning apparatus comprises a detection device that is designed for distinguishing between a standstill of the wet cleaning apparatus and a motion of the wet cleaning apparatus, wherein the displacement device is designed for causing a displacement of the cleaning element into the distant position when a standstill is detected. According to this embodiment, the wet cleaning apparatus has at least two different states of motion, namely motion and standstill. If the wet cleaning apparatus has a moving speed of zero, i.e. stands still, the displacement device causes the cleaning element to be lifted off the area and/or prevents the cleaning element from being placed onto the area. If a moving speed other than zero is detected, no removal of the cleaning element from the area takes place, but the cleaning element can in fact remain in contact with the area or be lowered onto the area. The cleaning element particularly remains in its previous operating position, in which the cleaning element is lowered onto the area to be cleaned.

The detection device may be alternatively or additionally be designed for determining the value of a current moving speed of the wet cleaning apparatus relative to the area and for comparing the determined value with a threshold value stored in a memory, wherein the displacement device is designed for causing a displacement of the cleaning element into the distant position if the threshold value is not reached. In a particularly simple instance, the threshold value is zero such that all determined moving speeds, which are faster or slower than 0 m/s, are evaluated as a motion of the wet cleaning apparatus relative to the area and the cleaning element is therefore not lifted off the area. According to an alternative embodiment, the threshold value for preventing an excessively long exposure of the area to the cleaning element may also be other than zero such that motions with speeds, which are in fact not equal to 0 m/s, but so slow that the thusly caused exposure period of a section of the area could lead to damages, are also evaluated as a standstill and therefore entail lifting the cleaning element off the area. For example, the wet cleaning apparatus has moving speeds, at which the cleaning element remains in a defined position excessively long, such that these moving speeds have to be treated as if the wet cleaning apparatus were at a standstill. Such a threshold value may lie, for example, at a moving speed of 10 mm/s or less. The detection device therefore compares a measured current speed value with the threshold value, whereupon a control unit of the wet cleaning apparatus, which is assigned to the displacement device, either generates a control command for raising the cleaning element or not. The defined threshold value may be stored in a memory of the wet cleaning apparatus, which can be accessed by the detection device. It is furthermore possible to define multiple threshold values that are used for the comparison by the detection device, for example in dependence on different types of cleaning elements, cleaning types, cleaning agents, floor types and/or moisture levels of the cleaning element.

It is proposed that the displacement device is assigned to a propulsion device of the wet cleaning apparatus, which contacts the area in a normal operating position. The propulsion device may be a wheel of the wet cleaning apparatus. The wheel may be a driving wheel of the wet cleaning apparatus or merely a guide or support wheel that rotates as the wet cleaning apparatus moves over an area to be cleaned. The propulsion device may alternatively also be realized in the form of a runner. The displacement device assigned to the propulsion device may comprise a pivoting mechanism, a displacement mechanism or the like, particularly also an actuator, preferably an electric motor or a spring element. The displacement mechanism particularly may be assigned to a suspension for the propulsion device, for example a wheel suspension. The suspension may comprise, for example, a telescoping rod assembly. The displacement device particularly may be in direct mechanical contact with the propulsion device, wherein the displacement device preferably causes a displacement of one or more propulsion devices beyond a lower housing contour of the wet cleaning apparatus in the direction of the area. In this way, the wet cleaning apparatus is propped up on the area together with the cleaning element. The displacement device may be assigned to a propulsion device on any sections of the wet cleaning apparatus as long as it is ensured that the cleaning element is lifted off the area to be cleaned when the displacement device is actuated.

An above-proposed detection device for detecting a motion and/or moving speed of the wet cleaning apparatus particularly may be assigned to a propulsion device of the wet cleaning apparatus. The detection device may be realized, for example, in the form of a tachometric or odometric measuring device that detects the rotation of a wheel of the wet cleaning apparatus. If distinction should only be made between motion and standstill without determination of a speed value, the wet cleaning apparatus could alternatively also comprise an acceleration sensor, by means of which it can be detected whether the wet cleaning apparatus currently stands still or moves relative to the environment. However, if a moving speed of the wet cleaning apparatus should be compared with a stored threshold value and the comparison is dependent on the speed value, it is recommended that the detection device is suitable for measuring a parameter that allows a calculation the current moving speed of the wet cleaning apparatus. If the determined moving speed falls short of a defined threshold value, the displacement device can cause the cleaning element to be lifted off an area.

It is furthermore proposed that the displacement device is assigned to a support element of the wet cleaning apparatus, which does not contact the area in a normal operating position of the wet cleaning apparatus. The support element may be realized, for example, in the form of an oblong stand similar to a bicycle kickstand, which in contrast to a propulsion device of the wet cleaning apparatus is not suitable for the propulsion on the area to be cleaned, but merely makes it possible to support the wet cleaning apparatus while it is at a standstill. The support element can be pivoted, displaced or extended relative to the device section being supported on the area. The support element particularly may be mounted on the device section such that it can be pivoted about a pivoting axis. The displacement of the support element causes an increase of the clearance height of the wet cleaning apparatus and therefore also an increase of the distance between the cleaning element and the area to be cleaned. It would furthermore be conceivable to arrange the support element on a linear displacement device, for example on a slide link or rail.

It is furthermore proposed that the cleaning element is mounted on a fixed device part of the wet cleaning apparatus such that it can be displaced by means of a displacement device. According to this embodiment, the wet cleaning apparatus maintains its distance from the area and its height on the area. Only the cleaning element, which is arranged within and/or underneath the housing of the wet cleaning apparatus, is displaced relative to the housing and/or another fixed device part such as a chassis. Due to this design, the wet cleaning apparatus can be advantageously prevented from getting stuck, for example, underneath a low obstacle such as a cabinet or a bed when the cleaning element is lifted off the area.

A spring element may be assigned to the displacement device, wherein the restoring force of said spring element is oriented in the direction of the distant position of the cleaning element, in which it is lifted off the area. The spring element may be assigned, for example, to the propulsion means or the support element of the wet cleaning apparatus or even to a mechanism that displaces the cleaning element relative to the fixed device part. The spacing of the cleaning element is promoted by the restoring force of the spring element. For example, a spring-loaded suspension of a propulsion means, particularly a wheel suspension, may have a restoring force that is increased in comparison with the usual restoring force. As proposed above, the restoring force of the spring element is preferably oriented in a direction that points away from the area to be cleaned such that the cleaning element is displaced away from the area, for example during a malfunction of the energy supply of the wet cleaning apparatus due to a completely discharged accumulator, and there is no risk of the cleaning element inadvertently remaining in contact with the area. For safety reasons, the preferential position of the cleaning element or the displacement device therefore is the distant position, in which it is spaced apart from the area. Accordingly, the cleaning element preferably has to be actively lowered onto the area.

It is ultimately proposed that the wet cleaning apparatus comprises a moisture sensor that detects a moisture level of the cleaning element, wherein the displacement device is designed for additionally controlling the displacement of the cleaning element in dependence on the detected moisture level. In addition to the dependence of the displacement of the cleaning element on the state of motion and/or an error status of the wet cleaning apparatus, the displacement of the cleaning element is therefore also dependent on the detection result of a moisture sensor, which determines the moisture level of the cleaning element and only causes a displacement of the cleaning element away from the area if the cleaning element actually has a moisture level that exceeds a critical moisture threshold value, for example during a standstill or at an excessively slow moving speed of the wet cleaning apparatus. A completely dry cleaning element respectively can remain on or be lowered onto the area, namely even if the wet cleaning apparatus is at a standstill.

The invention furthermore proposes a set consisting of a wet cleaning apparatus of the above-described type and a base station for charging an accumulator of the wet cleaning apparatus, wherein the wet cleaning apparatus is a self-traveling cleaning robot, and wherein the wet cleaning apparatus and the base station comprise corresponding electrical contacts.

According to a first embodiment, the wet cleaning apparatus and/or the base station comprises at least three electrical contacts, wherein a control unit of the wet cleaning apparatus and/or a control unit of the base station is designed for variably reversing the polarity of at least two of the electrical contacts of the wet cleaning apparatus or the base station depending on a distance of the electrical contacts from the area in order to charge the accumulator.

According to a second embodiment, the electrical contacts of the wet cleaning apparatus and/or the electrical contacts of the base station are displaceably arranged on the wet cleaning apparatus and/or the base station, wherein a control unit of the wet cleaning apparatus and/or a control unit of the base station is designed for displacing the electrical contacts in dependence on a distance of the electrical contacts from the area in order to charge the accumulator.

Both above-described embodiments with electrical contacts, the polarity of which can be reversed or which can be displaced with respect to their height in dependence on a state of motion or an error status of the wet cleaning apparatus, make it possible to also produce an electrically conductive connection between the corresponding electrical contacts of the wet cleaning apparatus and the base station if the height of the wet cleaning apparatus and therefore also the absolute spatial position of the electrical contacts changes due to a displacement of the cleaning element and/or the device section being supported on the area.

According to the initially proposed embodiment, the ability to charge the accumulator of the wet cleaning apparatus is ensured in that at least one additional third charging contact is made available on the wet cleaning apparatus in an elevated position referred to two other electrical contacts. Alternatively, the additional third charging contact may also be realized on the base station. The positions, particularly heights, of the electrical contacts correspond to the known positions of the housing of the wet cleaning apparatus during a lowered operating position of the cleaning element and during a distant position of the cleaning element, in which it is lifted off the area. In this case, the control unit is designed for correspondingly switching the electrical contacts, namely for reversing their polarity relative to one another, in such a way that identical polarities lie on the same height level and therefore can be connected to one another. For example, a detection device may also be assigned to the electrical contacts, wherein this detection device respectively detects the polarity of the electrical contacts of the wet cleaning apparatus and the base station and accordingly reverses the polarity of the corresponding electrical contacts of the base station and the wet cleaning apparatus.

According to the alternatively proposed embodiment, the base station and the wet cleaning apparatus may conventionally comprise only two electrical contacts, but at least the electrical contacts of the wet cleaning apparatus or the electrical contacts of the base station have to be displaceable with respect to their height in this case. For example, the electrical contacts of the base station can be adapted to a changed height of the electrical contacts of the wet cleaning apparatus.

BRIEF DESCRIPTION OF THE DRAWINGS

The invention is described in greater detail below with reference to exemplary embodiments. In the drawings.

DETAILED DESCRIPTION OF THE PREFERRED EMBODIMENTS

Figure 1:
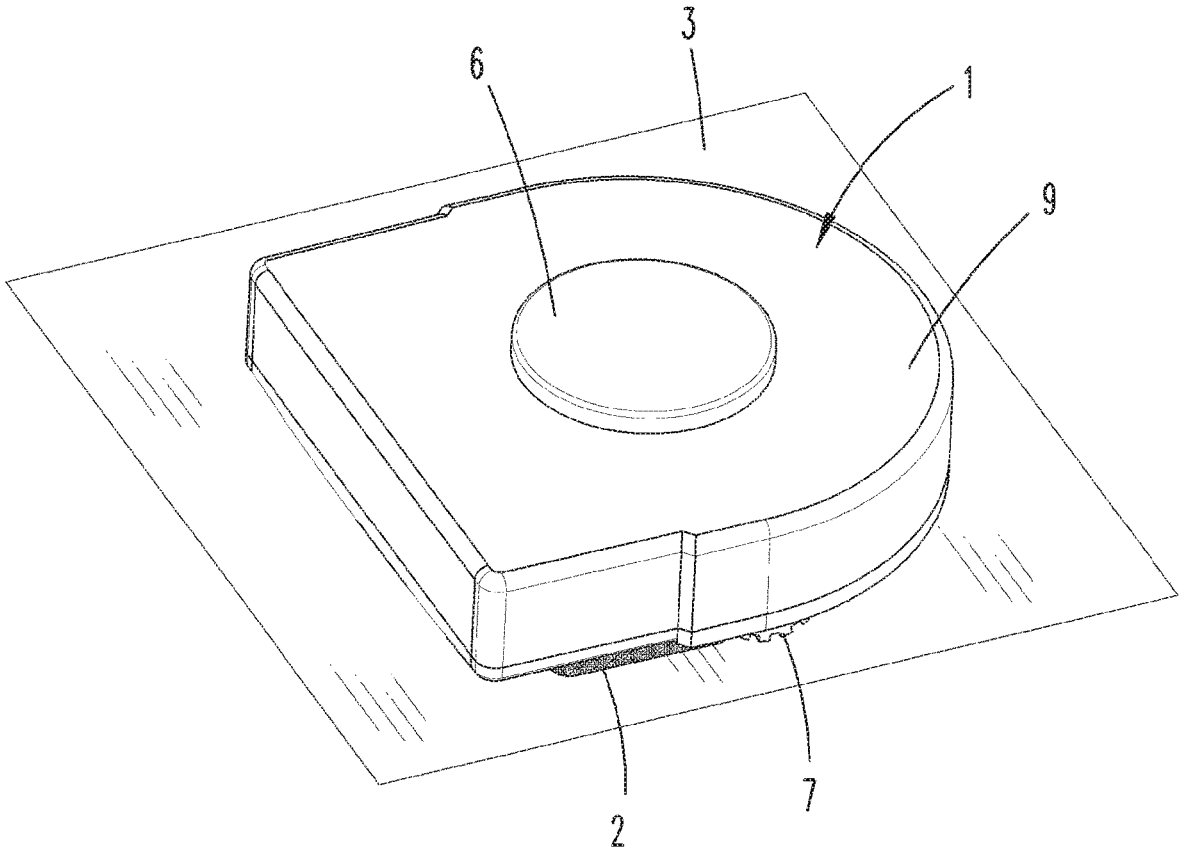
FIG. 1 shows an inventive wet cleaning apparatus.

FIG. 1 shows an exemplary embodiment of an inventive wet cleaning apparatus 1. In this exemplary embodiment, the wet cleaning apparatus 1 is realized in the form of a self-traveling wiping robot for cleaning an area 3. The wet cleaning apparatus comprises a housing that forms a fixed device part 9, a cleaning element 2 and multiple propulsion devices 7 (of which only one is visible in FIG. 1). The cleaning element 2 usually is directly or indirectly mounted on a fixed device part 9 such as the housing or a chassis by means of a carrier or a holding device. For example, the cleaning element 2 may consist of a wiping cloth, particularly a microfiber cloth, which is separably fixed on a carrier plate. The carrier plate may in turn be arranged on a swing plate that preferably moves over the area 3 to be cleaned in the form of circular orbital motions. Other embodiments are possible. For example, the cleaning element 2 could also be arranged on a rotating roller that rotates about a preferably horizontal axis. FIG. 1 shows a normal operating position of the cleaning element 2, in which the cleaning element 2 rests on the area 3 in order to mechanically clean this area. A cleaning liquid such as water is normally used for the cleaning process. However, the cleaning liquid may also contain an additional cleaning agent, which comprises a surfactant or the like that enhances the cleaning effect. The cleaning liquid can either be applied directly onto the area 3 to be cleaned and/or onto the cleaning element 2. The moisturization is preferably realized by means of an automatic moisturizing device of the wet cleaning apparatus 1. The wet cleaning apparatus 1 can move autonomously on the area 3 with the aid of the propulsion devices 7. The propulsion devices 7 are preferably realized in the form of motor-driven wheels. In this context, the term propulsion devices 7 also includes devices that in fact are not actively driven, but serve for the propulsion of the wet cleaning apparatus 1. These devices include, for example, support wheels, runners and the like. In this case, the autonomous motion of the wet cleaning apparatus 1 is supported by a navigation and self-localization device of the wet cleaning apparatus 1, which includes a detection device 6 that is realized in the form of a distance measuring device in this case. The detection device 6 measures distances from objects within the environment of the wet cleaning apparatus 1 and can generate an environment map based on these measured distances, wherein the wet cleaning apparatus 1 can orient itself with the aid of said environment map during the autonomous motion through rooms in order to avoid a collision with obstacles, to reach a certain destination and the like.

Although the embodiments illustrated in the drawings concern autonomously moving wet cleaning apparatuses 1, the invention can likewise be applied to wet cleaning apparatuses 1 that are hand-operated by a user. Only a few of many other possible embodiments of the invention are described below in a merely exemplary manner.

Figure 2A:
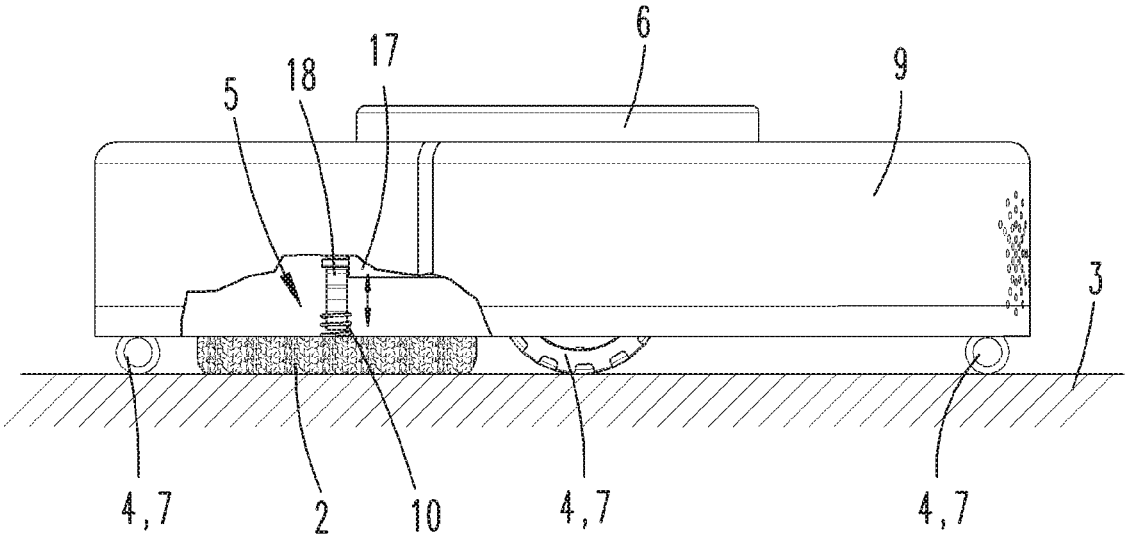
FIG. 2*a* shows a wet cleaning apparatus according to a first embodiment with a cleaning element in an operating position.
Figure 2B:
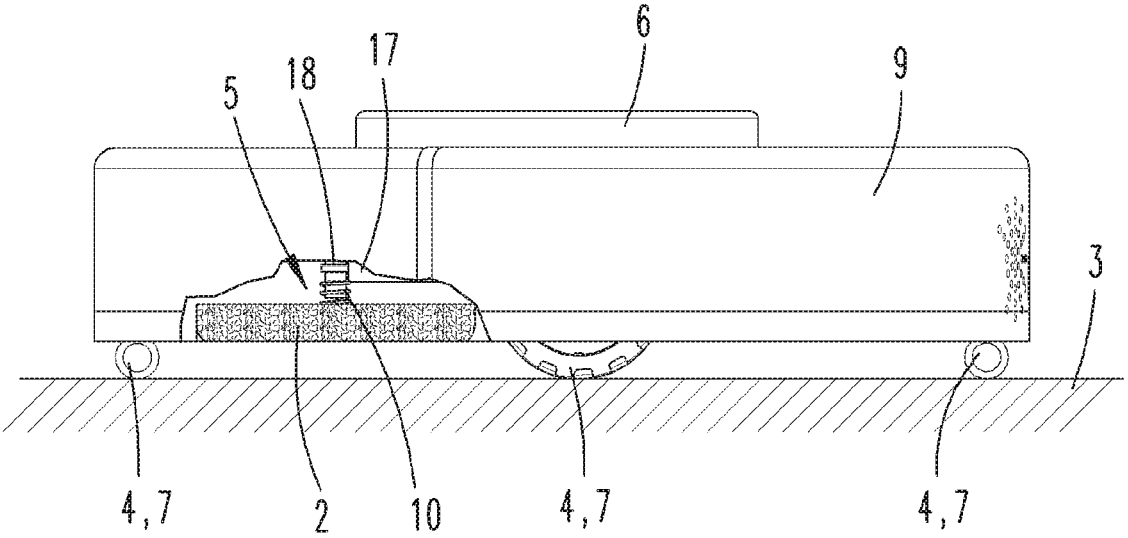
FIG. 2*b* shows the wet cleaning apparatus according to FIG. 2*a* with the cleaning element in a distant position.

FIGS. 2*a* and 2*b* initially show a first embodiment, in which the cleaning element 2 can be displaced relative to the fixed device part 9 and relative to the propulsion device 7. The propulsion devices 7 respectively form a device section 4 that always maintains contact with the area 3 and supports the wet cleaning apparatus 1 relative to the area 3. In this case, the wet cleaning apparatus 1 comprises two propulsion devices 7 that are realized in the form of driving wheels, as well as two pairs of support wheels that merely rotate passively when the wet cleaning apparatus 1 is in motion. The cleaning element 2 can be displaced relative to the propulsion devices 7 being supported on the area 3 and therefore also relative to the area 3 by means of a displacement device 5, i.e. the cleaning element can be lifted off the area 3 into a distant position or placed onto the area 3 for the operating position. In this case, the displacement device 5 comprises a displacement mechanism 18 that is driven by an electric motor 17 and can move the cleaning element 2 up and down relative to the area 3. A spring element 10 is assigned to the displacement mechanism 18, wherein the restoring force of said spring element acts in the direction of the distant position of the cleaning element 2, in which it is lifted off the area 3, such that the cleaning element 2 is automatically moved away from the area 3 during an error status of the wet cleaning apparatus 1, for example due to a complete failure of the energy supply of the wet cleaning apparatus 1. The cleaning element 2 therefore has to be actively lowered into the operating position illustrated in FIG. 2*a* by means of the displacement device 5. The displacement device 5 furthermore comprises a control unit (not shown) that issues a control command for the electric motor 17, which in turn actuates the displacement mechanism 18. The displacement device 5, namely its control unit, is designed in such a way that the displacement of the cleaning element 2 takes place in dependence on a state of motion and/or an error status of the wet cleaning apparatus 1. The term state of motion refers to whether the wet cleaning apparatus 1 currently moves relative to the area 3 or stands still thereon and/or to the moving speed, with which the wet cleaning apparatus 1 moves over the area 3. In a particularly simple instance, there are only two states of motion, namely moving on the one hand and standing still on the other hand. An error status may concern, for example, a state of the wet cleaning apparatus 1, in which it is stuck on or underneath an obstacle, a completely discharged accumulator such that no more energy is available for the electric motor of the propulsion device 7 and the like. In many instances, an error status simultaneously manifests itself in the state of motion "standstill." In addition, an error status may also refer to an error that does not concern the motion of the wet cleaning apparatus, but rather, for example, the proper function of a cleaning drive that moves the cleaning element 2 over an area 3 to be cleaned. In the above-described instances, it may be advantageous to remove the cleaning element 2 from the area 3, i.e. to displace the cleaning element into the distant position, such that the particularly moist or wet cleaning element 2 does not rest on a certain region of the area 3 for an undesirably long period of time and cannot cause damages to the area 3, e.g. in the form of swelling of a wood floor, in this region.

The wet cleaning apparatus 1 comprises a detection device 16 for detecting a state of motion and/or error status of the wet cleaning apparatus 1, wherein said detection device obtains information on a possible standstill of the wet cleaning apparatus 1 based on the detection of distances from obstacles, which change while the wet cleaning apparatus 1 is in motion. The displacement device 5 can then cause a displacement of the cleaning element 2 in dependence on the detected state of motion and/or error status. In this case, the cleaning element 2 can be displaced by merely deactivating the electric motor 17 such that the spring element 10 actuates the displacement mechanism 18 in accordance with its restoring force and raises the cleaning element 2.

An evaluation unit is assigned to the detection device 6 and/or the displacement device 5, wherein said evaluation unit calculates, for example, a current speed of the wet cleaning apparatus 1 from the successively recorded distance measurement data of the detection device 6 and compares the calculated speed value with a stored threshold value. If the calculated speed is slower than the threshold value or even zero, the displacement device 5 causes the cleaning element 2 to be lifted off the area 3. This is realized, for example, by deactivating the electric motor 17. The threshold value can be specified by the user or the manufacturer. It is also possible to specify multiple threshold values, particularly in dependence on a floor type of the area 3, because a standstill of the wet cleaning apparatus 1, during which the moist cleaning element 2 and the area 3 are in constant contact, will be less damaging to the area 3 than, for example, a standstill on a wood floor. Furthermore, the displacement of the cleaning element 2 may also be dependent on a moisture level of the cleaning element 2 because a completely dry cleaning element 2 also does not affect the area 3 during a prolonged standstill on the area 3. A moisture sensor may be assigned to the cleaning element 2 in order to detect the moisture level.

FIG. 2*b* shows the wet cleaning apparatus 1 with the cleaning element 2 displaced into a distant position. In this case, the cleaning element 2 is completely lifted off the area 3 and no longer in contact therewith. This embodiment has the advantage that the absolute height of the wet cleaning apparatus 1 on the area 3 does not change, but only the cleaning element 2 is displaced relative to the wet cleaning apparatus 1, for example the fixed device part 9 and the propulsion device 7. Since the cleaning element 2 is in this case covered by the fixed device part 9, it also does not protrude beyond an upper device contour, which in this case is defined by the detection device 6, in the distant position. The wet cleaning apparatus 1 is thereby prevented from getting stuck underneath obstacles due to a sudden change of the absolute height of the wet cleaning apparatus 1 during a displacement of the cleaning element 2 relative to the area 3.

Figure 3A:
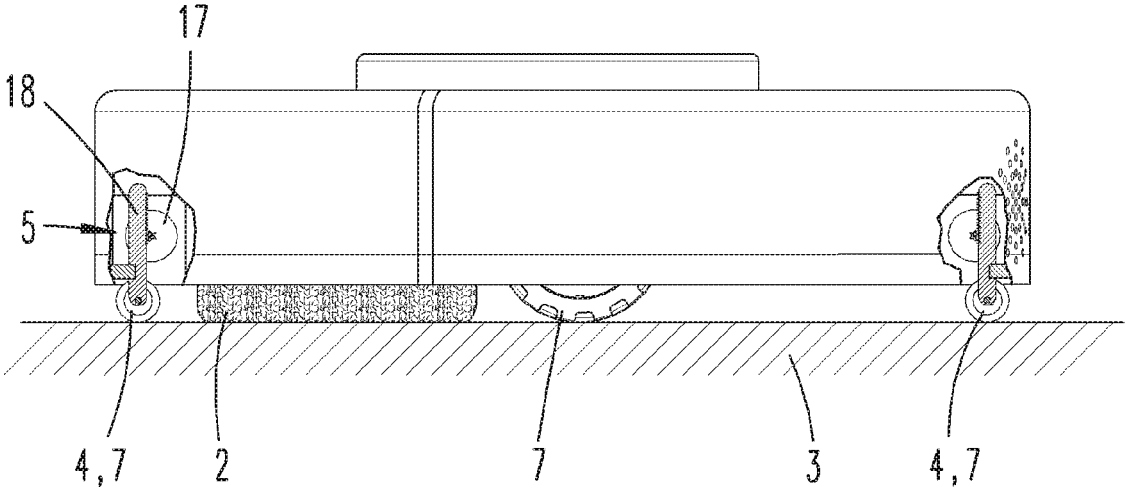
FIG. 3*a* shows a wet cleaning apparatus according to a second embodiment with a cleaning element in an operating position.
Figure 3B:
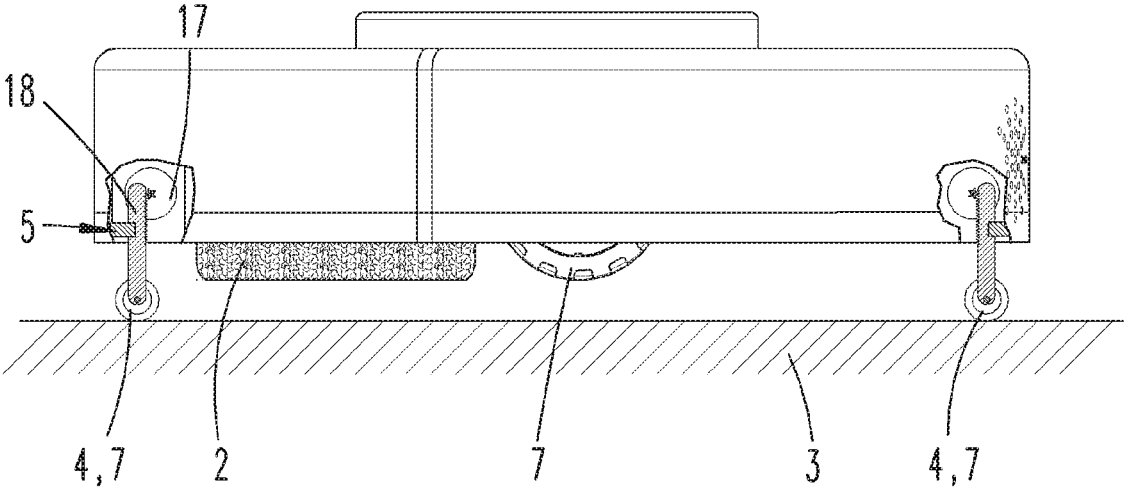
FIG. 3*b* shows the wet cleaning apparatus according to FIG. 3*a* with the cleaning element in a distant position.

FIGS. 3*a* and 3*b* show a second exemplary embodiment of the invention, in which the displacement device 5 causes a displacement of a device section 4 that supports the wet cleaning apparatus 1 relative to the area 3, in this case the propulsion devices 7 in the form of support wheels, in dependence on a detected standstill of the wet cleaning apparatus 1, an excessively slow moving speed referred to a threshold value or an error status. The detection of the state of motion and/or the error status may take place as described above with reference to FIGS. 2*a* and 2*b*. For the purpose of the displacement, the displacement device 5 comprises a displacement mechanism 18 that is assigned to the support wheels, wherein said displacement mechanism is driven by an electric motor 17 and additionally displaces the support wheels out of the housing of the wet cleaning apparatus 1 referred to a bottom contour of the fixed device part 9 of the wet cleaning apparatus 1 such that the ground clearance of the wet cleaning apparatus 1 is increased. The cleaning element 2, as well as the propulsion devices 7 in the form of driving wheels, are lifted off the area 3 by propping up the wet cleaning apparatus 1.

Figure 4A:
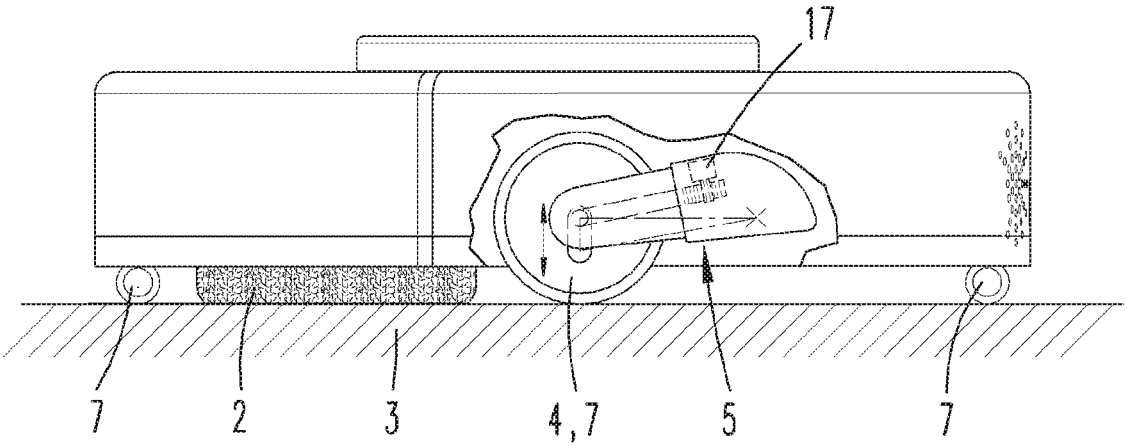
FIG. 4*a* shows a wet cleaning apparatus according to a third embodiment with a cleaning element in an operating position.
Figure 4B:
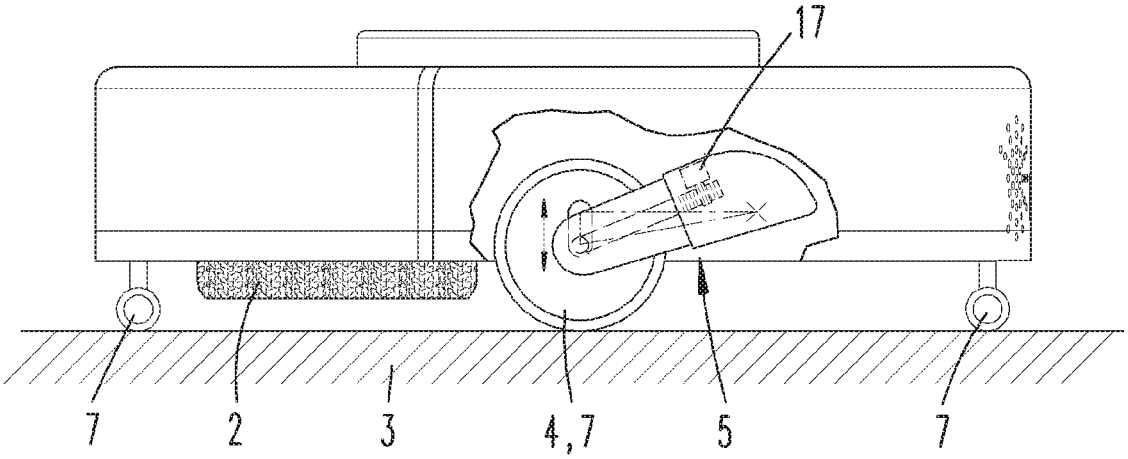
FIG. 4*b* shows the wet cleaning apparatus according to FIG. 4*a* with the cleaning element in a distant position.

FIGS. 4*a* and 4*b* show another embodiment that resembles the embodiment according to FIGS. 3*a* and 3*b*. However, a displacement device 5 is also assigned to the driving wheels in this case.

Figure 5A:
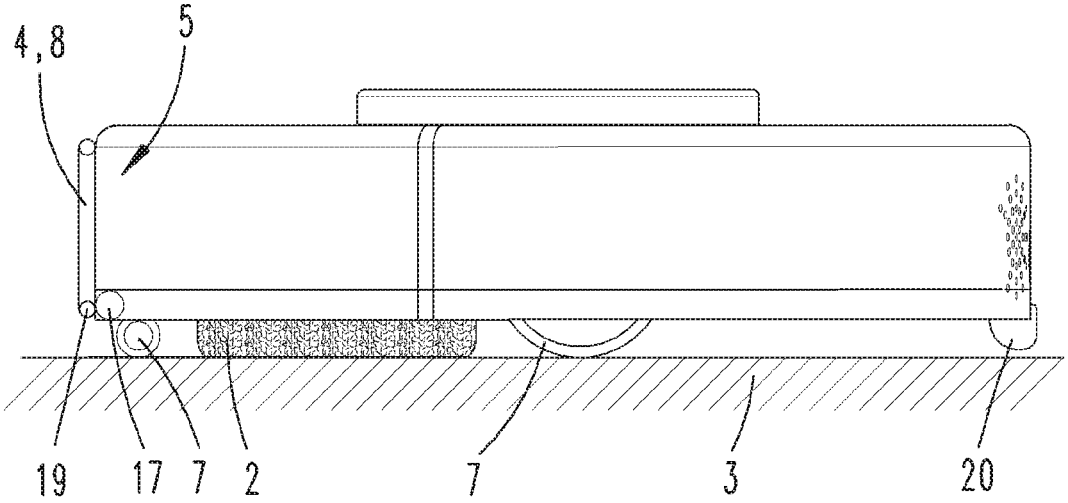
FIG. 5*a* shows a wet cleaning apparatus according to a fourth embodiment with a cleaning element in an operating position.
Figure 5B:
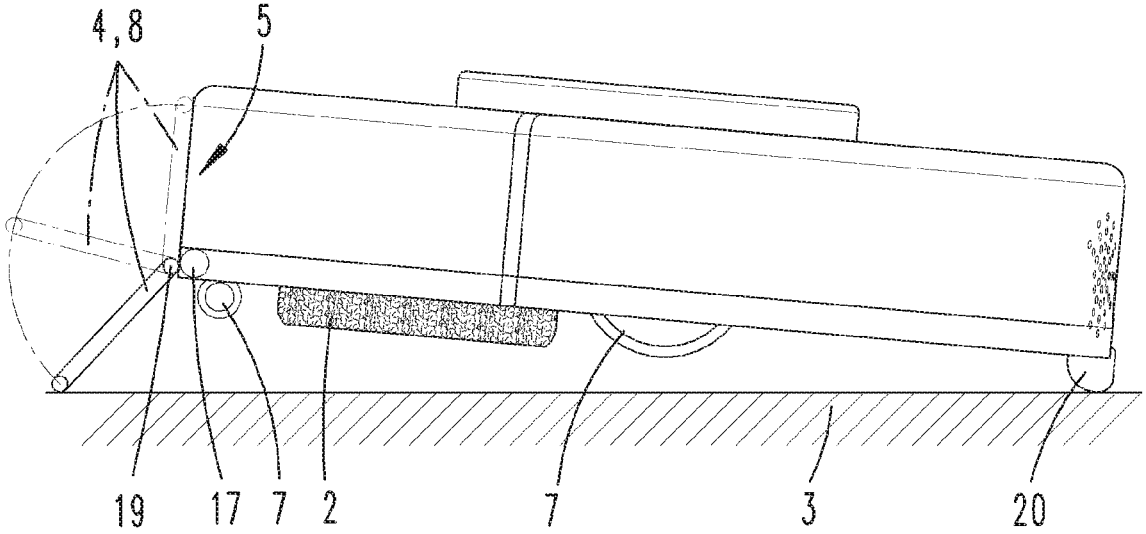
FIG. 5*b* shows the wet cleaning apparatus according to FIG. 5*a* with the cleaning element in a distant position.

FIGS. 5*a* and 5*b* show a wet cleaning apparatus 1 with a device section 4 that is realized in the form of a support element 8. The support element 8 is mounted such that it can be pivoted about a pivoting axis 19. An electric motor 17 for pivoting the support element 8 is assigned to the pivoting axis 19. The support element 8 is realized in the form of an oblong stand that can be placed onto the area 3. Continued pivoting after the support element 8 has reached the area 3 causes the wet cleaning apparatus 1 to be obliquely propped up, wherein the wet cleaning apparatus 1 is slanted and supported on the area 3 by means of a friction element 20 that lies opposite of the support element 8. The friction element 20 may be realized, for example, in the form of a rubber coating on the housing of the wet cleaning apparatus 1 and ensures that the friction between the housing and the area 3 is in the oblique position of the wet cleaning apparatus so high that the housing does not shift on the area 3.

Figure 6A:
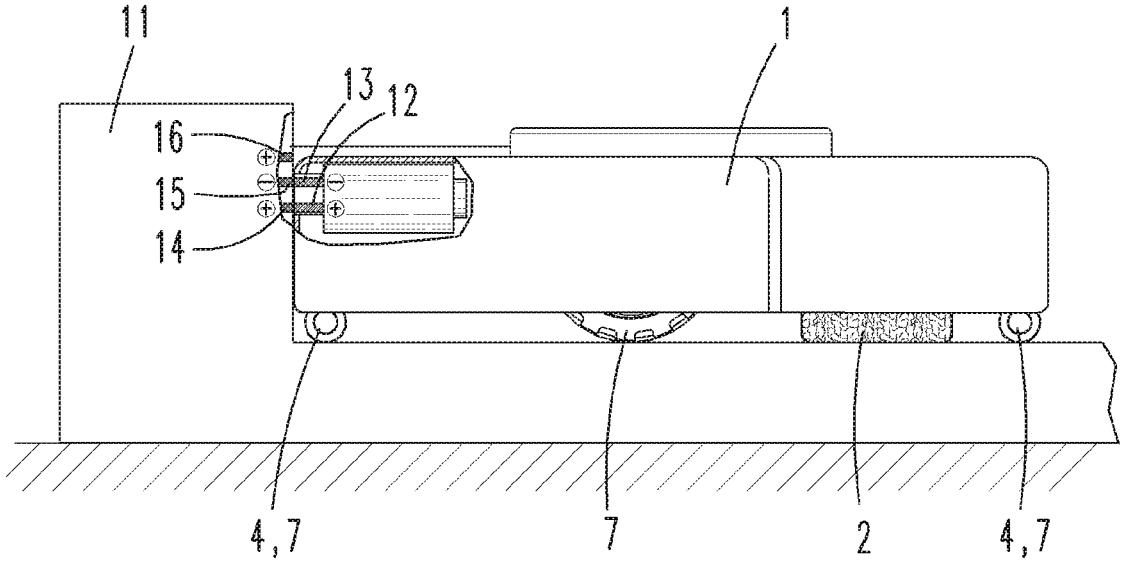
FIG. 6*a* shows a set consisting of a base station and a wet cleaning apparatus with a first polarity direction of electrical contacts of the wet cleaning apparatus.
Figure 6B:
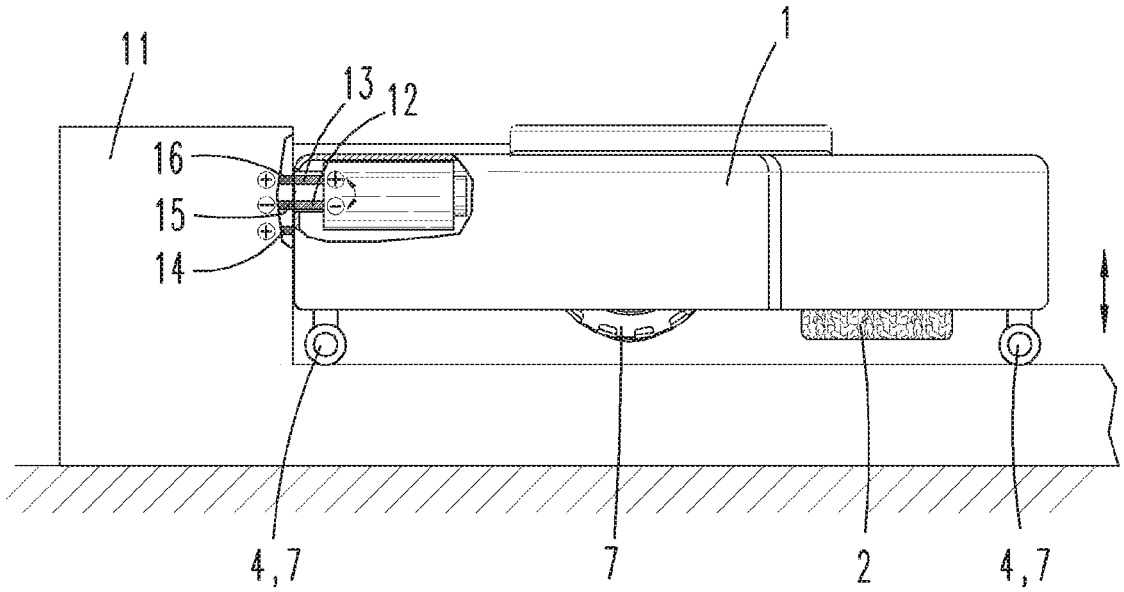
FIG. 6*b* shows the set according to FIG. 6*a* with a second polarity direction of the electrical contacts.

FIGS. 6*a* and 6*b* ultimately show a special embodiment of the wet cleaning apparatus 1. The wet cleaning apparatus 1 is illustrated in the form of a set in combination with a base station 11 that serves for charging an accumulator (not shown) of the wet cleaning apparatus 1. The base station 11 may furthermore also be designed for performing other service tasks such as storing cleaning liquid and/or applying cleaning liquid onto the cleaning element 2. The base station 11 comprises a total of three electrical contacts 14, 15, 16 for charging the accumulator of the wet cleaning apparatus 1. In this case, the electrical contacts 14, 15, 16 alternately have a positive and a negative potential. As an example, the wet cleaning apparatus 1 is in this case realized similar to the embodiment according to FIGS. 3*a* and 3*b*. In addition, the wet cleaning apparatus 1 comprises two electrical contacts 12, 13 that are connected to the accumulator via a charging circuit. The charging circuit is designed for detecting which potential is applied to the electrical contacts 14, 15, 16. A control unit of the charging circuit is designed for reversing the polarity of the electrical contacts 12, 13 of the wet cleaning apparatus 1 in dependence on the detected polarity of the electrical contacts 14, 15, 16, of the base station 11, which lie opposite thereof at the same height.

According to FIGS. 6*a* and 6*b*, the height of the electrical contacts 12, 13 of the wet cleaning apparatus 1 depends on the state of displacement of the cleaning element 2 because the height of the wet cleaning apparatus 1 changes when the cleaning element 2 is lifted off the area. As a result, the height of the electrical contacts 12, 13 also changes such that the electrical contacts 12, 13, 14, 15, 16 of the base station 11 and the wet cleaning apparatus 1, which lie opposite of one another at the same height, no longer have the same potential. When the wet cleaning apparatus 1 is propped up as illustrated in FIG. 6*b* and therefore has a greater height on the area 3, the electrical contacts 12, 13 of the wet cleaning apparatus 1 no longer lie opposite of the electrical contacts 14, 15 of the base station, but rather opposite of the electrical contacts 15, 16. For example, the electrical contact 12 with positive potential lies opposite of the electrical contact 15 of the base station 11 with negative potential. The electrical contact 13 of the wet cleaning apparatus 1 with negative potential then lies opposite of the electrical contact 16 of the base station 11 with positive potential. In order to charge the accumulator, the control unit reverses the polarity of the electrical contacts 12, 13 of the wet cleaning apparatus 1 such that the electrical contact 12 subsequently has a negative potential and the electrical contact 13 has a positive potential as illustrated in FIG. 6*b*. After that, the accumulator can be charged via the charging circuit. The potential check of the electrical contacts 12, 13, 14, 15, 16 is carried out anew when the wet cleaning apparatus 1 is lowered relative to the area 3. The base station 11 may also comprise more than three electrical contacts 14, 15, 16 depending on the number of possible height positions of the wet cleaning apparatus 1. It is furthermore also possible that a base station 11 only comprises two electrical contacts 14, 15 and the wet cleaning apparatus 1 in turn comprises more than two electrical contacts 12, 13. In addition, the base station 11 and the wet cleaning apparatus 1 may respectively comprise more than two electrical contacts 12, 13, 14, 15, 16. According to an alternative embodiment, the base station 11 may likewise comprise electrical contacts 14, 15, 16 with reversible polarity.

Another not-shown embodiment of the wet cleaning apparatus 1 could furthermore comprise electrical contacts 12, 13 that can be displaced with respect to their height relative to the fixed device part 9, wherein the electrical contacts 12, 13 are displaced in dependence on a changing height of these electrical contacts such that they always lie opposite of electrical contacts 14, 15, 16 of the base station 11 with the same potential. Alternatively, the base station 11 could also comprise such displaceable electrical contacts 14, 15, 16.

LIST OF REFERENCE SYMBOLS

1 Wet cleaning apparatus
2 Cleaning element
3 Area
4 Device section
5 Displacement device
6 Detection device
7 Propulsion device
8 Support element
9 Fixed device part
10 Spring element
11 Base station
12 Electrical contact
13 Electrical contact
14 Electrical contact
15 Electrical contact
16 Electrical contact.
17 Electric motor
18 Displacement mechanism
19 Pivoting axis
20 Friction element

What is claimed is:

1. A wet cleaning apparatus comprising;

a cleaning element for mechanically wet cleaning an area to be cleaned, a device section that supports the wet cleaning apparatus relative to the area, a displacement device configured for automatically causing a displacement of the cleaning element relative to the device section or vise versa in dependence on a state of motion and/or an error status of the wet cleaning apparatus such that the cleaning element can be displaced from an operating position, in which the cleaning element is lowered onto the area, into a distant position, in which the cleaning element is lifted off the area, and a detection device assigned to the displacement device, the detection device being designed for distinguishing between a standstill of the wet cleaning apparatus and a motion of the wet cleaning apparatus, wherein the displacement device is designed for causing a displacement of the cleaning element into the distant position when a standstill is detected by the detection device and/or wherein the detection device is designed for determining a value of a current moving speed of the wet cleaning apparatus relative to the area and for comparing the determined value with a threshold value stored in a memory, and wherein the displacement device is designed for causing a displacement of the cleaning element into the distant position if the threshold value is not reached.

2. The wet cleaning apparatus according to claim 1, wherein the displacement device is assigned to a propulsion device of the wet cleaning apparatus, which contacts the area in a normal operating position of the wet cleaning apparatus.

3. The wet cleaning apparatus according to claim 1, wherein the displacement device is assigned to a support element of the wet cleaning apparatus, wherein the support element does not contact the area in a normal operating position of the wet cleaning apparatus.

4. The wet cleaning apparatus according to claim 1, wherein the cleaning element is mounted on a fixed device part of the wet cleaning apparatus such that the cleaning element can be displaced by the displacement device.

5. The wet cleaning apparatus according to claim 1, wherein a spring element is assigned to the displacement device, wherein a restoring force of said spring element is oriented in a direction of the distant position of the cleaning element.

6. The wet cleaning apparatus according to claim 1, further comprising a moisture sensor configured for detecting a moisture level of the cleaning element and being assigned to the displacement device, wherein the displacement device is designed for additionally controlling the displacement of the cleaning element in dependence on the detected moisture level.

7. A set consisting of the wet cleaning apparatus according to claim 1 and a base station for charging an accumulator of the wet cleaning apparatus, wherein the wet cleaning apparatus is a self-traveling cleaning robot, and wherein the wet cleaning apparatus and the base station comprise corresponding electrical contacts, wherein the wet cleaning apparatus and the base station comprise at least three corresponding electrical contacts, wherein a control unit of the wet cleaning apparatus and/or a control unit of the base station is designed for variably reversing a polarity of at least two of the electrical contacts of the wet cleaning apparatus or the base station in dependence on a distance of the electrical contacts from the area in order to charge the accumulator.

8. A set consisting of the wet cleaning apparatus according to claim 1 and a base station for charging an accumulator of the wet cleaning apparatus, wherein the wet cleaning apparatus is a self-traveling cleaning robot, and wherein the wet cleaning apparatus and the base station comprise corresponding electrical contacts, wherein the electrical contacts of the wet cleaning apparatus and/or the electrical contacts of the base station are displaceably arranged on the wet cleaning apparatus and/or the base station, wherein a control unit of the wet cleaning apparatus and/or a control unit of the base station is designed for displacing the electrical contacts in dependence on a distance of the electrical contacts from the area in order to charge the accumulator.

* * * * *